United States Patent [19]

Skoog

[11] Patent Number: 4,630,674

[45] Date of Patent: Dec. 23, 1986

[54] PLATE HEAT EXCHANGER

[75] Inventor: Malte Skoog, Tumba, Sweden

[73] Assignee: Malte Skoog Invent Ab, Lund, Sweden

[21] Appl. No.: 111,472

[22] Filed: Jan. 11, 1980

[30] Foreign Application Priority Data

Jan. 17, 1979 [SE] Sweden ..... 7900410-7

[51] Int. Cl.[4] ..... F28F 13/08; F28F 3/04

[52] U.S. Cl. ..... 165/147; 165/167

[58] Field of Search ..... 165/166, 167, 146, 147; 159/28 P

[56] References Cited

U.S. PATENT DOCUMENTS

| | | | |
|---|---|---|---|
| 2,777,674 | 1/1957 | Wakeman | 165/167 |
| 2,787,446 | 4/1957 | Ljungstrom | 165/167 |
| 2,872,165 | 2/1959 | Wennerberg | 165/167 R |
| 3,731,737 | 5/1973 | Jenssen | 165/167 |
| 3,807,496 | 4/1974 | Stadmark | 165/167 |

FOREIGN PATENT DOCUMENTS

| | | | |
|---|---|---|---|
| 2109346 | 10/1971 | Fed. Rep. of Germany | 165/107 |
| 1267143 | 3/1972 | United Kingdom . | |
| 1275130 | 5/1972 | United Kingdom | 165/167 |
| 1368593 | 10/1974 | United Kingdom . | |

*Primary Examiner*—Sheldon J. Richter

*Attorney, Agent, or Firm*—Cyrus S. Hapgood

[57] ABSTRACT

In a heat exchanger comprising a plurality of plates arranged adjacent to each other and defining between them passages for heat exchanging fluids, the plates are provided at their corner portions with openings, the fluids being conveyed to and from the passages via said openings. The openings for one of the fluids are located at one side of the plates and the openings for the other fluid are located at the other side of the plates. The plates are provided with a corrugation pattern which varies in a direction transverse to the flow direction in such way that the passages are narrower shallower at the side of the plates at which the inlet and outlet openings of the respective passages are provided and wider deeper at the opposite side.

8 Claims, 8 Drawing Figures

PLATE HEAT EXCHANGER

The present invention relates to a heat exchanger comprising a plurality of plates arranged adjacent to each other and sealed off against one another, said plates having a turbulence-generating corrugation pattern and defining between them passages for two heat exchanging fluids which are conveyed to and from the passages via openings provided at the corner portions of the plates, the two openings for one of the fluids being located at one side of the plates and the two openings for the other fluid being located at the other side of the plates.

Due to the fact that the inlet and outlet openings of each heat exchanging passage are both located at the same side of the heat exchanger, different portions of the flow will choose different lengths of flow paths through the passage. Some of the flow will pass the shortest way along a straight line between the openings, while the rest of the flow will pass a longer way along a bigger or smaller curve between the openings.

On the assumption that the flow resistance per unit of length is equal for different flow paths, the flow velocity in a longer path will be lower than in a shorter path. The portion of the flow taking the longest way at the lowest velocity will consequently stay for a considerably longer time in the passage than the portion taking the shortest way at the highest velocity. The thermal treatment of different portions of the flow will thereby be different, which is objectionable for several reasons. Thus, the described manner of operation does not fulfil the requirements for an efficient utilizing of the heat exchanger. Further, the different thermal treatments may affect the quality of the final product.

Hitherto, attempts have been made to solve the abovementioned problem by controlling the flow by means of distribution means provided adjacent to the openings such that a distribution is obtained which as far as possible is even across the width of the passages. However, the loss of pressure caused by these distribution means have not at all or to only a minor extent been utilizable for the heat transmission.

In a heat exchanger made in accordance with the present invention, the flows of the heat exchanging fluids can be controlled in such way that the flow velocity will be generally proportional to the length of the flow path through the heat exchanging passages. The residence time and the thermal treatment of the fluids in the heat exchanging passages will thereby be generally equal both for the portion of the flow taking a longer way and the portion taking a shorter way through the passages. This has been achieved by means of a heat exchanger of the aforementioned kind which is characterized in that the corrugation pattern of the plates varies in a direction transverse to the flow direction, whereby the volume per unit of width of the passages varies in such way that the passages are narrower shallower at the side of the plates at which the inlet and outlet openings of the respective passages are provided and wider deeper at the opposite side.

The invention will be described in more detail below with reference to the accompanying drawings, in which FIG. 1 is a diagrammatic, exploded perspective view of four heat exchanging plates;

Figure 1:
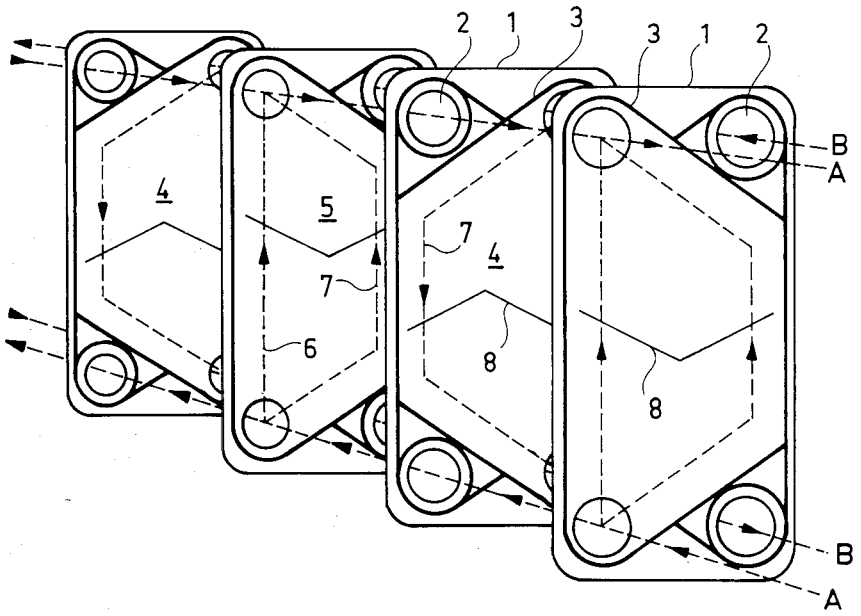

The four heat exchanger plates 1 shown in FIG. 1 are identical, every second plate being turned 180° in its own plane in relation to the others. The plates are provided in a conventional way with openings 2 and gaskets 3, sealed heat exchanging passages 4, 5 being formed between the plates. The flows of the two heat exchanging fluids are indicated with broken lines and are designated A and B respectively. For each fluid a shorter path 6 is indicated through the respective passage (i.e., along a straight line between the openings 2) and a longer path 7 extending in a curve along the opposite long side of the passage. Of course, the fluids flow across the whole width of the passage, but for the sake of simplicity only these two flow paths have been illustrated.

The heat exchanging surfaces of the plates are provided with a corrugation pattern which is indicated diagrammatically at 8 in FIG. 1. As there shown, the two indicated flow paths 6 and 7 have essentially differing lengths which, as mentioned above, has an influence on the flow velocity and residence time of the fluids in the passages.

Figure 4:
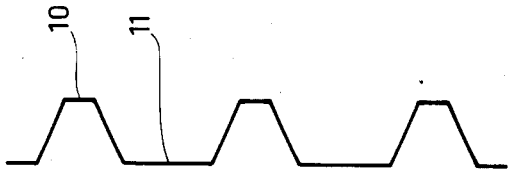
FIGS. 3 and 4 are sectional views along lines III—III and IV—IV, respectively, in FIG. 2.
Figure 3:
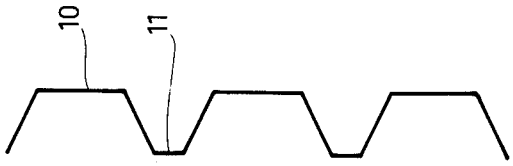
Figure 2:
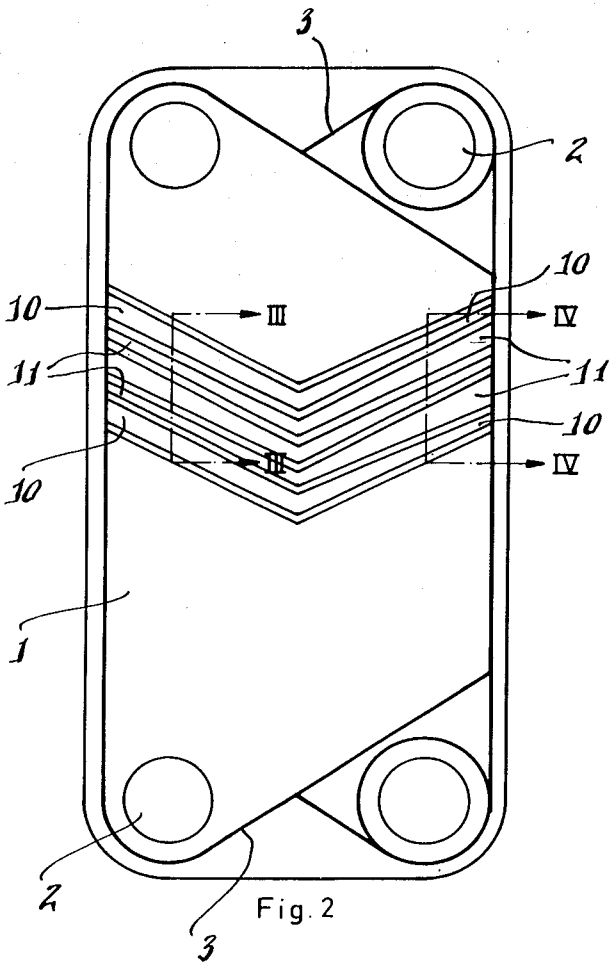
FIG. 2 is a diagrammatic plan view on a larger scale of one of the plates in FIG. 1.

The plate illustrated in FIGS. 2–4 is provided with a so-called herringbone corrugation pattern which is only partly indicated in FIG. 2. As appears from FIGS. 3 and 4, the plates are provided with trapezoidal creases having ridges 10 and grooves 11, the ridges 10 having a continuously decreasing width as seen from left to right in FIG. 2, and the grooves 11 having a continuously increasing width as seen in the same direction.

Figure 6:
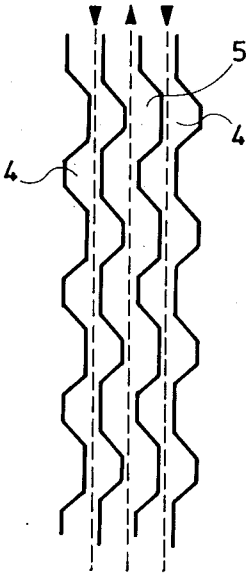
FIGS. 5 and 6 are longitudinal sectional views through a series of plates.
Figure 5:
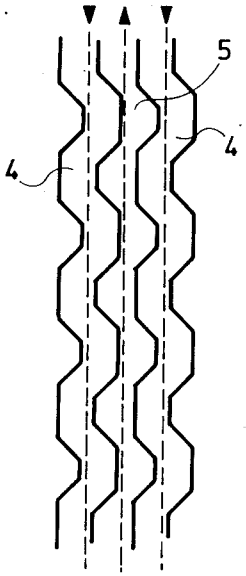

The longitudinal sections in FIGS. 5 and 6 are located generally according to III—III and IV—IV, respectively, in FIG. 2; but they are sections of a series of plates disposed adjacent to each other. The plates are made generally according to FIGS. 2–4. In FIG. 5, of the passages 4 and 5 formed between the plates the passages 4 have a larger volume and the passages 5 have a smaller volume. In FIG. 6 this relation is reversed. The sections of the passages shown narrowr shallower in FIGS. 5 and 6 are located in a shorter flow path 6 (FIG. 1) while the wider deeper sections are located in a longer flow path 7. Thus, the volume per unit of width of the passages varies continuously in the transverse direction of the plates, whereby the flow velocity is affected such that the velocity will be higher in a longer flow path and lower in a shorter flow path. As a result, the thermal treatment of the heat exchanging fluids will be generally the same irrespective of the length of the flow path through the passages.

Figure 7:
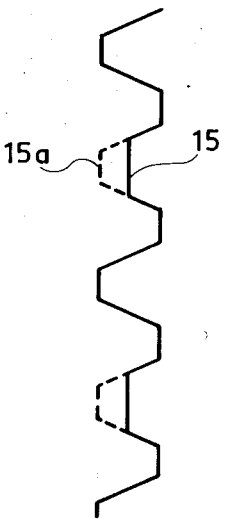
FIG. 7 is a sectional view corresponding to FIGS. 3 or 4 of another embodiment of a heat exchanger plate.

Another embodiment of the invention is shown in FIG. 7. In this embodiment every second of the grooves is made with varying depth, as shown at 15. By varying the depth of the plates in the transverse direction of the plate, an effect corresponding to that described with reference to FIGS. 5 and 6 can be obtained. In order to obtain a sufficient number of supporting points between the plates, certain sections of the grooves 15 may be made with a full depth, as indicated at 15*a*.

Figure 8:
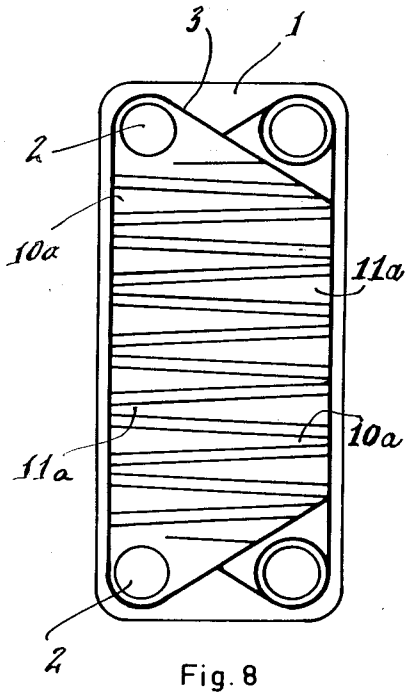
FIG. 8 is a diagrammatic plan view of a further embodiment of a heat exchanger plate according to the invention.

The plate in FIG. 8 differs from those described above in that the corrugations are unbroken and extend in the transverse direction of the plate. In other respects the embodiment is essentially the same in that the grooves and ridges of the corrugation have a width and/or depth that varies in the transverse direction of the plate. The ridges and grooves in FIG. 8 are shown at 10*a* and 11*a*, respectively.

In the above-described embodiments, the corrugations are made with gradually varying dimensions. However, it is also within the scope of the invention to change the dimensions of the corrugations step by step.

In the following claims, the "width" of a passage is the distance from one side edge to the opposite side edge of the passage. Thus, in FIG. 2 the width of the passage is the horizontal distance between the two opposite vertical parts of gasket 3. The depth of a passage is the spacing between adjacent plates forming the passage. Thus, in the section represented by FIG. 5 the passages 4 are relatively deep and passage 5 is relatively shallow.

As will be apparent from the foregoing, each plate 1 has opposite faces on which its corrugation pattern forms elongated flow-resisting elements (e.g., the ridges 10 and grooves 11 in FIGS. 2–4) which extend generally transversely of the main flow direction along said faces, the main flow direction being vertical in the drawings. Referring to FIG. 1, where the flow-resisting elements in FIGS. 2–4 are indicated diagrammatically at 8, the rear face of the first (nearest) plate 1 will have the grooves of its flow-resisting elements decreasing in width from a maximum at the left side edge to a minimum at the right side edge of the plate, as in the case of the opposing front face of the second plate, since the latter is turned 180° in its own plane relative to the first and third plates. Thus, said elements in the first passage 4 will impose their maximum flow resistance to flow along the right side edges of the first and second plates, which edges are adjacent the short flow path 6, and will impose their minimum flow resistance to flow along the left side edges which are adjacent the long flow path 7.

Still referring to FIG. 1, the rear face of the second plate 1 will have the grooves of its flow-resisting elements decreasing in width from a maximum at the right side edge to a minimum at the left side edge of the plate, as in the case of the opposing front face of the third plate. Thus, said elements in the passage 5 will impose their maximum flow resistance to flow along the left side edges of the second and third plates, which edges are adjacent the short flow path 6, and will impose their minimum flow resistance to flow along the right side edges which are adjacent the long flow path 7.

I claim:

1. A plate heat exchanger comprising a plurality of generally rectangular plates stacked together to define between them passages for two heat exchanging fluids, the plates having openings at the corner regions thereof for conveying said fluids to and from respective passages, each plate having inlet and outlet openings for one fluid located adjacent one side edge of the plate and having inlet and outlet openings for the other fluid located adjacent the opposite side edge of the plate, the plates having corrugations defining alternate ridges and grooves which extend across the plates to increase turbulence of the heat exchanging fluids in the passages, the cross-section of each corrugation groove increasing along the length of the groove in such a direction that the volume per unit width of each passage changes across the width of the two plates defining said passage, said volume per unit width of each passage being relatively small adjacent those side edges of said two plates which are nearer said inlet and outlet openings through which fluid is conducted to and from said passage, said volume per unit width of each passage being relatively larger adjacent the opposite side edges of said two plates.

2. The heat exchanger of claim 1, in which the width of each corrugation groove increases along the length of the groove.

3. The heat exchanger of claim 1, in which the depth of at least some of said grooves changes along the length of the grooves.

4. The heat exchanger of claim 1, in which each corrugation ridge decreases in cross-section along the length of the ridge in the same direction in which an adjacent groove increases in cross-section.

5. The heat exchanger of claim 1, in which the ridges of adjacent plates cross and abut each other in said passages.

6. The heat exchanger of claim 1, in which at least some adjacent plates are identical, one of the identical plates being turned 180° in its own plane relative to each adjacent identical plate.

7. The heat exchanger of claim 6, in which the ridges of adjacent plates cross and abut each other in said passages.

8. A plate heat exchanger comprising a plurality of generally rectangular plates stacked together to define between them passages for two heat exchanging fluids, the plates having openings at the corner regions thereof for conveying said fluids to and from respective passages, each plate having inlet and outlet openings for one fluid located adjacent one side edge of the plate and having inlet and outlet openings for the other fluid located adjacent the opposite side edge of the plate, the plates having corrugations defining alternate ridges and grooves which extend across the plates to increase turbulence of the heat exchanging fluids in the passages, the cross-section of each corrugation ridge increasing along the length of the ridge in such a direction that the volume per unit width of each passage changes across the width of the two plates defining said passage, said volume per unit width of each passage being relatively small adjacent those side edges of said two plates which are nearer said inlet and outlet openings through which fluid is conducted to and from said passage, said volume per unit width of each passage being relatively large adjacent the opposite side edges of said two plates.

* * * * *